United States Patent [19]

Lebourg

[11] Patent Number: 4,858,706

[45] Date of Patent: Aug. 22, 1989

[54] DIAMOND DRILL BIT WITH HEMISPHERICALLY SHAPED DIAMOND INSERTS

[76] Inventor: Maurice P. Lebourg, 5592 Longmont, Houston, Tex. 77056

[21] Appl. No.: 208,407

[22] Filed: Jun. 17, 1988

Related U.S. Application Data

[63] Continuation-in-part of Ser. No. 96,895, Sep. 15, 1987, abandoned.

[51] Int. Cl.[4] ..... E21B 10/48

[52] U.S. Cl. ..... 175/329; 175/330; 175/383; 175/404; 175/410; 175/413; 76/108 A; 76/DIG. 12; 125/39; 408/145

[58] Field of Search ..... 175/329, 330, 404, 403, 175/410, 412, 413, 383, 382; 76/108 A, DIG. 12, 108 R; 51/295; 125/39; 407/119; 408/145

[56] References Cited

U.S. PATENT DOCUMENTS

| | | | |
|---|---|---|---|
| 2,199,692 | 5/1940 | Catland | 255/61 |
| 3,027,952 | 4/1962 | Brooks | 175/329 |
| 3,311,181 | 3/1967 | Fowler | 175/410 |
| 3,318,399 | 9/1967 | Garner | 175/329 |
| 3,997,011 | 12/1976 | Staroba | 175/400 |
| 4,109,737 | 8/1978 | Bovenkerk | 175/329 |
| 4,254,840 | 3/1981 | Shay, Jr. | 175/410 |
| 4,373,593 | 2/1983 | Phaal et al. | 175/329 |
| 4,471,845 | 9/1984 | Jurgens | 175/329 |
| 4,716,976 | 1/1988 | Isakov | 175/410 |

OTHER PUBLICATIONS

Catalogue Entitled "Diamond Drilling," of Diamant Boart, May 1985.

Advertisement Entitled "New Hughes Diamond Technology and Old-Fashioned Service Cut Drilling Costs Worldwide", by Hughes Tool Company, 1986.

*Primary Examiner*—Bruce M. Kisliuk

*Attorney, Agent, or Firm*—Arnold, White & Durkee

[57] ABSTRACT

A rotary drill bit is provided which uses a plurality of hemispherically shaped diamond cutting elements, each having a cleaved, planar face. The diamonds are disposed in the bit such that the planar faces provide a plurality of knife-like cutting surfaces which fracture the formation being drilled and groove the fractured material.

16 Claims, 4 Drawing Sheets

Fig. 1
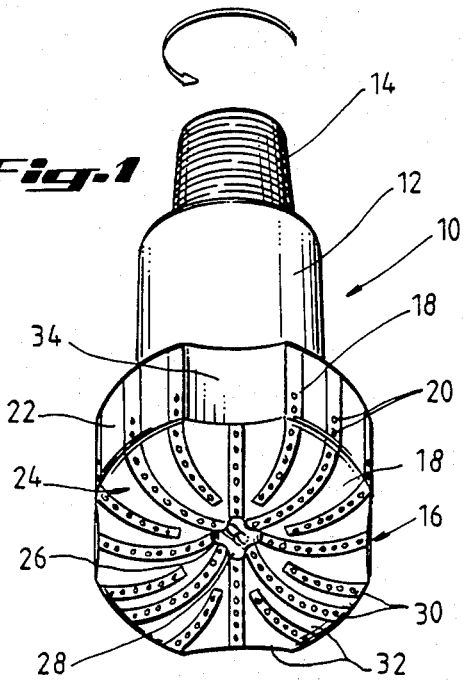
Fig. 2
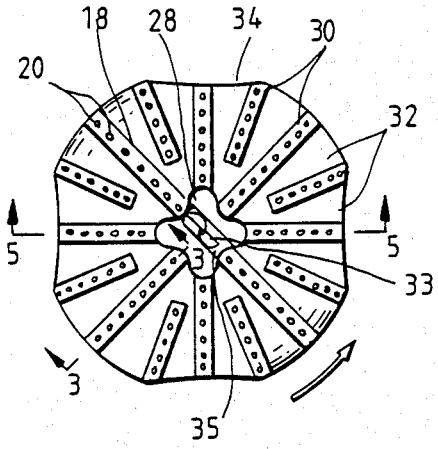
Fig. 3
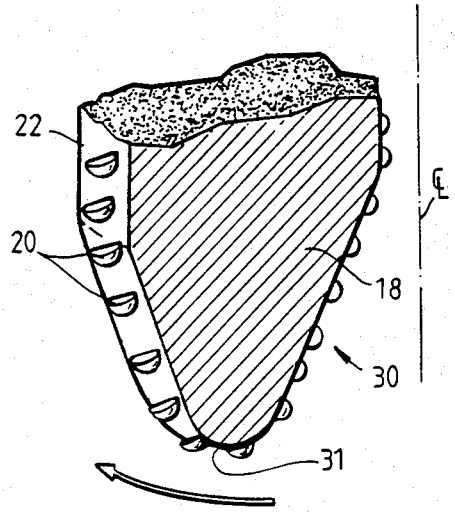
Fig. 3A
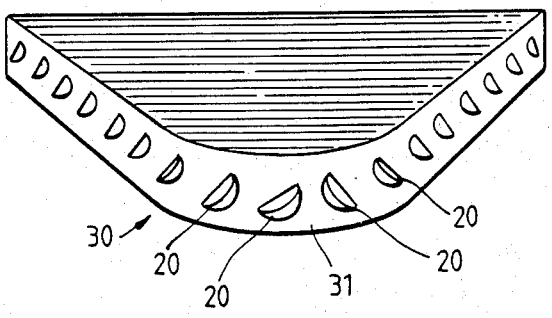
Fig. 5
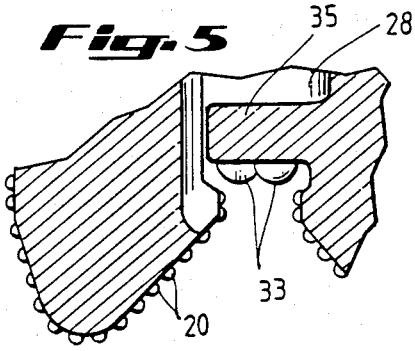
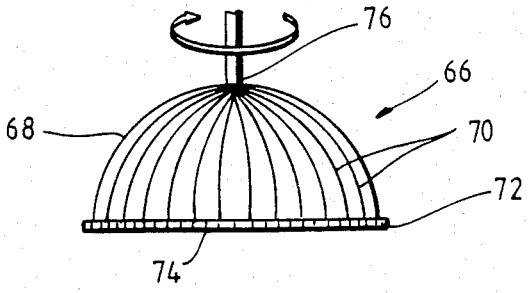
Fig. 11

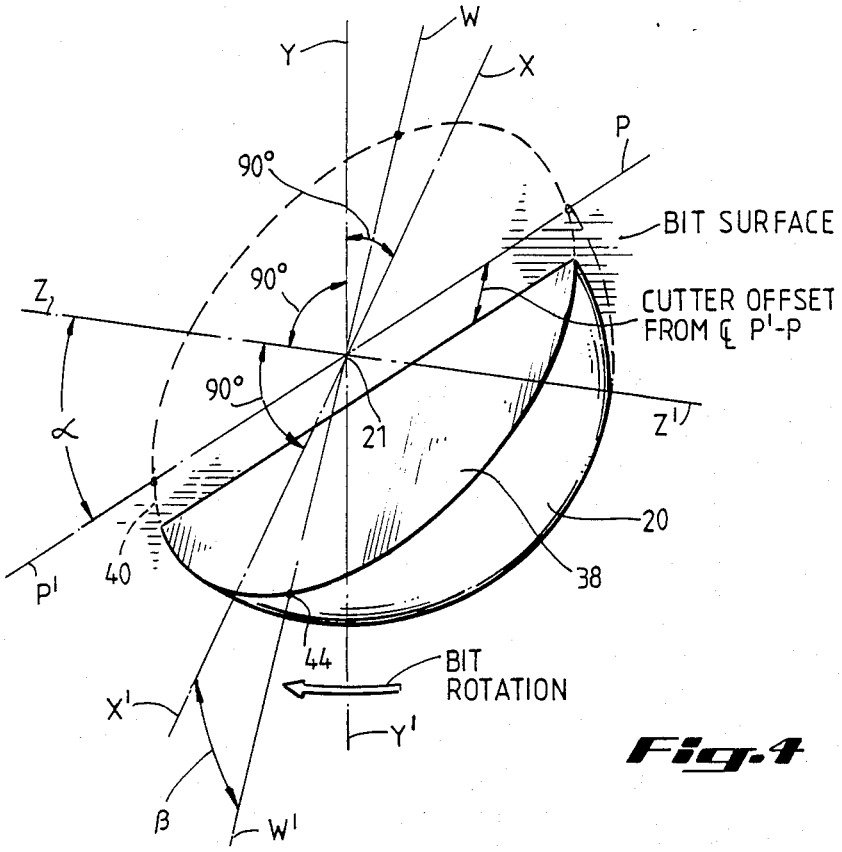
Fig.4
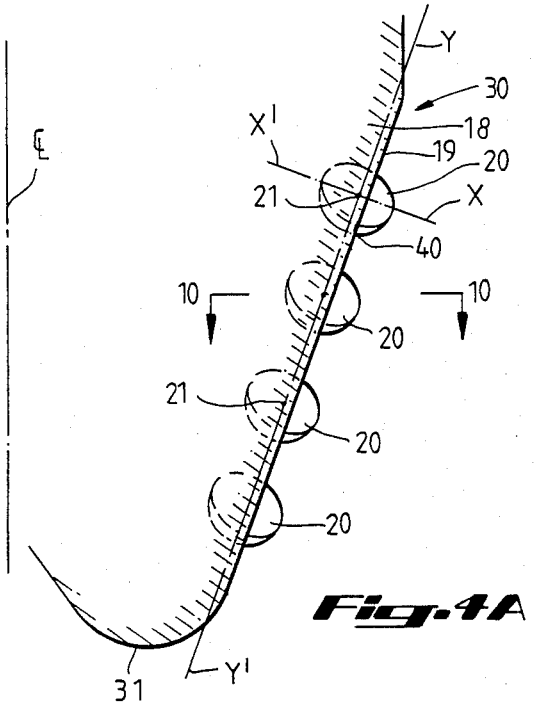
Fig.4A
Fig.10
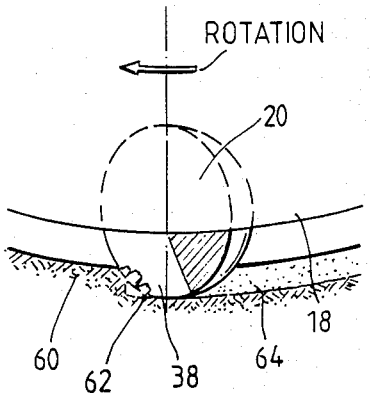

Fig. 6
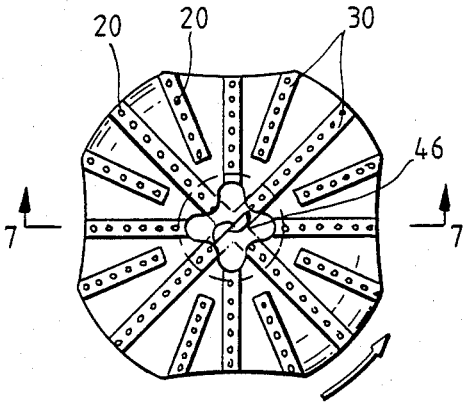
Fig. 7
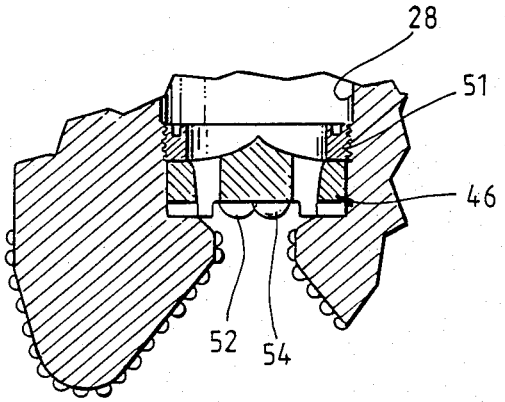
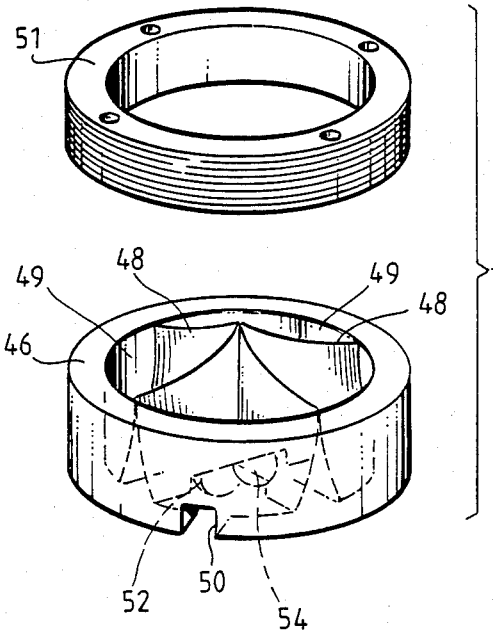
Fig. 8
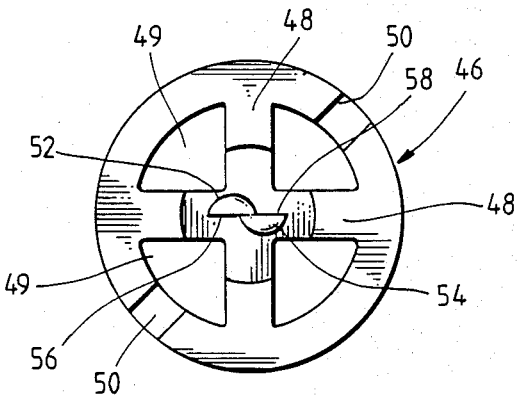
Fig. 9

DIAMOND DRILL BIT WITH HEMISPHERICALLY SHAPED DIAMOND INSERTS

This a continuation-in-part of application Ser. No. 096,895 filed Sept. 15, 1987 now abandoned.

BACKGROUND OF THE INVENTION

The present invention relates to rotary drill bits for drilling boreholes into subterranean formations. More particulary, the invention relates to a novel rotary bit design utilizing diamond cutting elements.

Drill bits utilizing diamonds or similar hard cutting elements are commonly employed in drilling and coring operations, particularly in hard subterranean formations such as chert, quartzitic sandstones or the like. The construction of such diamond drill bits usually includes a body portion having means for interconnection of the bit onto a drill string, and a matrix portion for mounting the diamonds or other cutting elements. Drilling fluid is directed down to the bottom of the borehole through the drill string and from a port generally disposed in the central portion of the bit. Fluid passageways or water courses that cross the drilling surfaces of the bit are also provided to transport this drilling fluid across the bit face to cool and lubricate the drilling surface of the bit and to facilitate movement of drill cuttings from the drilling area.

The general theory of diamond bit operation is not simply to crush the formation and thereby make drilling progress, but rather to create tiny fractures as the cutting elements pass over the formation so that drilling fluid which is maintained at a higher pressure than the formation pressure, can enter these fractures and remove the fractured portions of the formation. While most diamond bits use this crushing or fracturing action to create the hole, some bits have been developed which utilize a shearing action to cut through the formation.

Many different types of "diamond" cutting elements have been developed and used. These include natural diamonds, synthetic diamonds, and composites which include combinations of diamonds with other compounds such as tungsten carbide. Additionally, many different types of diamond shapes have been used. These include natural round stones, mechanically and chemically rounded and polished stones, natural cubic stones and natural octahedral stones. These stones have been inserted in many different configurations in diamond drill bits and in bits of many different shapes.

Although diamond drill bits are the best type of bit for hard formations, their penetration rate is lower than other types of bits since they generally have to rely on crushing and fracturing action to cut through the formation. Accordingly, it would be a significant advancement in the art to provide a diamond drill bit which retains the advantages of having the hard diamonds as the cutting elements while providing a means for increasing the penetration rate of the bit. Such a bit is disclosed and claimed herein.

SUMMARY OF THE INVENTION

The present invention provides a novel drill bit which utilizes hemispherically shaped diamond inserts having a cleaved face to cut through rock formations. The diamond inserts are preferably formed by cleaving round diamonds in half.

The drill bit comprises a body portion having a matrix for holding the diamonds in place. Passageways are created across the face of the matrix to allow drilling fluid to cool and lubricate the bit and carry cuttings away. These passageways divide the face of the drill bit into a plurality of fins. A plurality of hemispherically shaped diamond cutting elements are mounted in each of the fins.

The hemispherically shaped diamond cutting elements are embedded in the matrix of the bit such that a portion of the cleaved, planar face of each element is exposed. The elements are positioned such that they have a leading edge in the direction of rotation of the bit and an outer edge which is distal from the matrix. The leading edge is inclined downward at a first angle $\alpha$ from a plane normal to the face of the bit and parallel to the direction of rotation to create a pitch. The outer edge is inclined downward at a second angle $\beta$ from a plane normal to the face of the bit and parallel to the intersection of the planar face of the diamond element with the face of the bit.

The diamond edge penetrates and fractures the formation progressively and at the same time removes the fractured cuttings by grooving with the rotation of the bit. The pressure on the diamond is directed on the cleaved face which provides the maximum resistance without damaging the diamond.

The angle of inclination to create the pitch can be varied within suitable ranges depending upon the type of formation in which the bit will be used. For example, in extremely hard formations, the angles are smaller such that less material is removed with each rotation of the bit. For bits which are used in softer formations, the angles can be increased to provide for greater penetration rates.

In the preferred embodiment, a plurality of fins are provided and only a single row of diamond cutting elements is arranged in each fin. However, it is also possible to provide arrangements with diamond cutting elements side-by-side, provided that the cutting surfaces of the diamonds are properly aligned.

The grooving action of the cleaved diamonds can complete the fracturing of the debris and remove the fractured pieces which are held in place by the hydraulic pressure of the drilling mud in addition to simply fracturing the rock formation.

One advantage of the drill bit of the present invention is that it provides faster penetration rates than conventional diamond drill bits. The cutting action of the hemispherically shaped diamond inserts which slice and groove into the formation creates a borehole faster than the crushing and fracturing action of the prior art drill bits. A further advantage of the present invention is that the diamond cutting elements can be recycled by removing them from the matrix and rotating them such that a new edge of the hemisphere is exposed. Another advantage is that the major cutting forces are applied to the cleaved face of the diamond. These and other advantages of the present invention will be more fully apparent from the following description and attached drawings taken in conjunction with the claims.

BRIEF DESCRIPTION OF THE DRAWINGS

FIG. 1 is a perspective view of a drill bit embodying the present invention;

FIG. 2 is a plan view of the crown end of the drill bit of FIG. 1;

FIGS. 3 and 3A are perspective views of a slice of the bit illustrated in FIGS. 1 and 2;

FIGS. 4 and 4A–4C are schematic views illustrating the orientation of the diamond inserts in the matrix of the bit;

FIG. 5 is a partial cross-sectional view of the bit of FIGS. 1 and 2;

FIG. 6 is a plan view of the crown end of a second preferred embodiment of the present invention;

FIG. 7 is a partial cross-sectional view of the bit of FIG. 6.

FIG. 8 is a perspective view of the center cutting element of the bit of FIGS. 6 and 7.

FIG. 9 is a bottom plan view of the element of FIG. 8.

FIG. 10 is a cross-sectional view taken along line 10—10 of FIG. 4A showing the grooving action of the diamond inserts of the present invention.

FIG. 11 is a plan view of a tool used to form a mold for casting the bit of the present invention.

DETAILED DESCRIPTION OF THE PREFERRED EMBODIMENTS

Figure 4B:
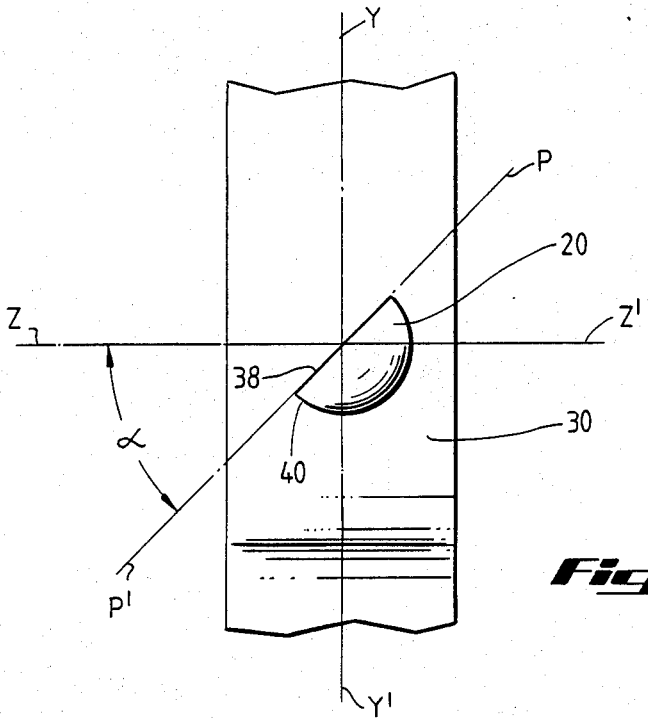

The present invention provides a novel design for a drill bit which utilizes cleaved, hemispherically shaped diamond cutting elements to provide a bit having increased penetration rates.

Reference is now made to the drawings in which like parts are designated with like numerals throughout. Illustrated in FIGS. 1 and 2 is a drill bit 10 of the type which may be constructed in accordance with the instant invention. Drill bit 10 comprises a body 12 formed of suitable material to withstand stress during operation. The upper portion of the body is provided with an exteriorly threaded neck 14 so that the bit 10 may be interconnected at the bottom of a drilling string. The lower body section or crown 16 of the bit 10 is surfaced with a metal matrix 18 in which the diamond cutting elements 20 may be embedded. The matrix is a relatively hard, tough material such as bronze, or a similar metal alloy such as copper nickel alloy containing powdered tungsten carbide in quantities sufficient to convey the required strength and erosion resistance. Alternatively, the matrix may be composed of a suitably hard plastic material capable of being cast upon the bit and having the properties of resisting wear and retaining the cutting elements. The material is of a suitable thickness to provide the required strength, resistance to erosion and abrasion, and to embed the diamond cutting elements firmly therein.

In casting the matrix material upon the bit body 12, it is common to provide recesses or a roughened surface on the bit body so that the matrix material will rigidly and firmly anchor to the bit body and form a permanent and fixed part of the drill bit.

In the embodiment illustrated in FIG. 1, the matrix of the drill bit is shaped to have a generally semitoroidal end face defining an outer cylindrical gauge face 22, a lower, generally curved drilling face 24, and an interior coring face 26. The interior face 26 opens into a central passageway 28 extending through the bit body, and through which drilling fluid is directed down the drill string to the formation and across the face of the bit. Matrix 18 is formed such that it has a plurality of fins 30 into which the diamond cutting elements 20 are embedded.

Fins 30 define a plurality of channels or water courses 32 which extend outwardly from the central passageway in the interior face, across the drilling face and up the gauge face of the bit. Accordingly, drilling fluid delivered through the drill pipe through passageway 28 is distributed through these flow passageways or water courses 32 to wash cuttings from the drilling area and upwardly to the top of the well as is well-known in the art. Additionally, in the embodiment illustrated, the matrix of the bit is provided with a series of junk slots 34 which are designed to discharge cuttings from the drilling area. It should be noted that a number of other configurations suitable for use on a diamond drilling bit would be obvious to those skilled in the art.

As can best be seen in FIG. 5, a pair of hemispherically shaped diamond cutting elements 33 are placed in a projection 35 in central passageway 28. Cutting elements 33 remove the core that is formed as drilling face 24 progresses through the formation.

Reference is next made to FIGS. 3, 3A, 4 and 4A—4C which illustrate the manner in which diamond cutting elements 20 are embedded in the matrix 18 in accordance with the teachings of the present invention. Cutting elements 20 have a hemispherical shape and a planar surface 38 formed by cleaving a diamond. In the preferred embodiment, cutting elements 20 are obtained by cleaving a round diamond in half.

Figure 4C:
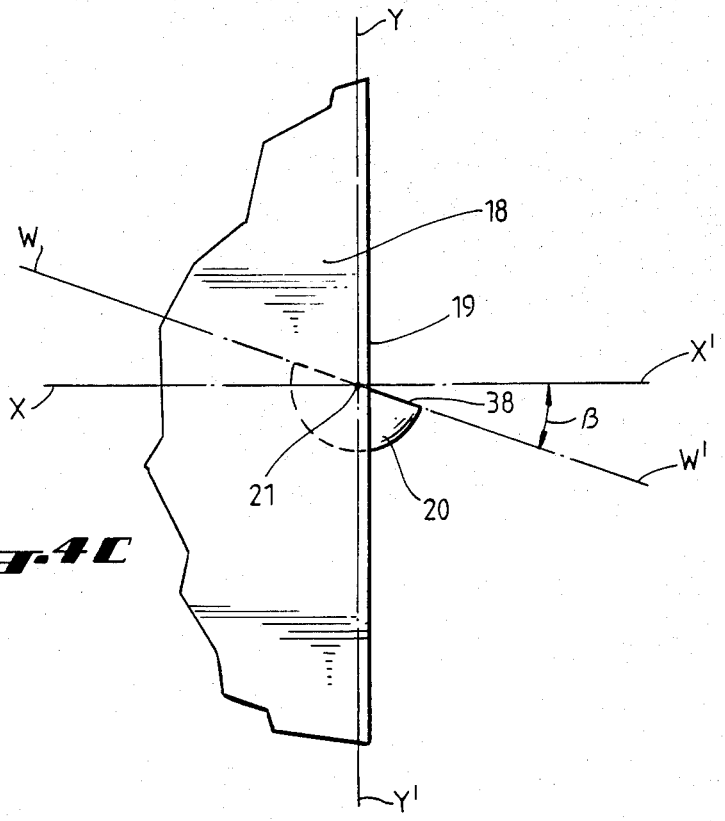

As can best be seen in FIG. 4A and 4C diamond cutting elements 20 are embedded in matrix 18 such that the center 21 of each element 20 is behind face 19 of matrix 18. Accordingly, slightly over half of each cutting element 20 is embedded within the matrix to ensure that the elements are securely fixed in place.

Diamond cutting elements 20 are orientated within matrix 18 of fins 30 to provide the optimum cutting surface. Generally, the rounded surface of cutting element 20 is oriented on the lowermost tip 31 of fin 30. The orientation of elements 20 can best be seen with reference to FIGS. 4 and 4A.

Illustrated in FIG. 4 are lines X—X', Y—Y' and Z—Z' which are oriented at 90 degrees to each other to define a three dimensional space and which intersect each other at center 21 of diamond element 20. The plane defined by Lines Y—Y' and Z—Z' is parallel to face 19 of fin 30 with line Y—Y' passing through the center 21 of diamond element 20. It should be appreciated that while line Y—Y' has been shown as a straight line for purposes of illustration in FIG. 4A, it is parallel to face 19 of fin 30 and will be a curved line where face 19 is curved. Line X—X' is perpendicular to face 19 of fin 30.

The flat or planar surface 38 which is defined by the cleaved face or element 20 is rotated in two directions with respect to the plane defined by lines X—X' and Z—Z'. First, as shown in FIG. 4B, leading edge 40 of element 20 is inclined downward around the X—X' axis at a first angle $\alpha$ as illustrated by line P—P' to create a pitch. This permits cutting element 20 to groove down into rock formations. Angle $\alpha$ can be increased or decreased depending upon the type of formation in which the bit will be used. Generally, angle $\alpha$ is within the range of 30–60 degrees. Preferably, angle $\alpha$ is about 45 degrees.

The outer edge 44 of diamond cutting element 20 is also inclined downward around the P—P's axis from a plane defined by lines X—X' and P—P' at a second angle $\beta$ as illustrated by line W—W' in FIG. 4. This downward inclination exposes the sharp cutting edge 44 and planar surface 38 of cutting element 20 to the formation being drilled. If angle $\beta$ is formed before angle α, the rotation occurs around the Z—Z′ axis as illustration in FIG. 4C. Angle β can also be adjusted within a suitable range depending upon the size of the cutting element and the hardness of the formation in which bit 10 will be used. Generally, angle β is within the range of 15–30 degrees. Preferably, angle β is about 30 degrees.

As can be seen from the foregoing, lines P—P′ and W—W′ define the planar surface 38 of element 20. This plane is rotated in two directions from the plane defined by lines X—X′ and Z—Z′ if angle β is created first. Otherwise, angle β is measured from the plane defined by lines X—X′ and P—P′.

As can be seen in FIGS. 3 and 3A, the orientation of the diamond cutting elements changes as they progress from the outer face to the interior face of bit 10. The greatest change occurs adjacent lower most tip 31 of fin 30.

Reference is next made to FIGS. 6–9 which illustrate a second preferred embodiment of the present invention. In this embodiment, fins 30 are substantially identical to the embodiment illustrated in FIGS. 1 and 2. A core cutting insert 46 is provided at the center of central passageway 28 to remove the core which is left as the formation is being drilled. Core cutting insert 46 is generally disk shaped with crossbars 48 and openings 49 formed in the center thereof. Insert 46 is positioned in central passageway 28 and is secured in place by threaded ring 51. Openings 49 permit drilling fluid to pass through insert 46 to clean and lubricate the face of bit 10. The upper edges of crossbars 48 are tapered to create as little turbulence as possible as the fluid passes through openings 49.

A pair of notches 50 are formed in the bottom of insert 46 to permit easy alignment of insert 46 within central passageway 28. The notches 50 also help prevent rotation of insert 46 within bit 10.

A pair of diamond cutting elements 52 and 54 are positioned in crossbars 48 for removing the core. Diamond cutting elements 52 and 54 are generally hemispherical in shape and are formed by cleaving generally round diamonds in half. The flat faces 56 and 58 of elements 52 and 54 are positioned such that they face each other. However, elements 52 and 54 are offset such that they only slightly overlap each other. When diamond cutting elements 52 and 54 become worn or break, insert 46 can easily be removed and replaced. Because the core is not supported, it is easily destructed in small fragments without retarding the penetration of the bit.

Reference is next made to FIG. 10 which illustrates the cutting and grooving action of diamond cutting elements 20. As planar surface 38 of cutting element 20 engages rock formation 60, it fractures and grooves the rock thus forming pieces 62 which are carried away by the drilling fluid. A groove 64 is formed in rock formation 60 by the cutting action of element 20.

FIG. 11 illustrates a tool 66 which can be used in the formation of a mold for casting bit 10. Generally, diamond bits are formed by mounting the diamonds in a graphite mold which is then filled with a metal powder that is sintered to form the matrix which holds the diamonds. Tool 66 includes a hemispherically shaped body 68 which is covered with a plurality of cutting blades 70. A ring 72, also covered with cutting blades is formed adjacent planar face 74 of body 68.

Body 68 is mounted on a shaft 76 for attachment to a suitable mill. Tool 66 is rotated by the mill and cuts a portion of a hemispherically shaped hole in the graphite mold into which diamond cutting elements 20 can be mounted. Since the edge of body 68 adjacent planar face 74 tends to wear first, ring 72 is provided to create a slightly larger opening adjacent the planar face. This ensures that the hole created by tool 66 is properly sized to receive the diamond cutting element 20, especially the sharp edge adjacent the cleaved face.

As can be seen from the foregoing, the present invention provides a novel drill bit design which uses hemispherically shaped diamond inserts having a cleaved face as cutting elements. The inserts are positioned in the matrix of the bit to expose a sharp cutting surface which knives through the formation being drilled to provide faster penetration rates than other types of diamond drilling bits.

While the invention has been described with respect to the preferably preferred embodiments, it will be appreciated that changes and modifications can be made without departing from the scope or essential characteristics of the invention. Accordingly, the scope of the invention is defined by the appended claims rather than by the foregoing description. All changes or modifications which come within the meaning and range of equivalency of the claims are to be embraced within their scope.

What is claimed is:

1. A rotary drill bit for drilling a hole in subterranean formations comprising:

a body portion including a matrix forming a face of said bit;

means to define fluid passageways across said matrix, said means dividing said matrix into a plurality of fins; and a plurality of hemispherically shaped diamond cutting elements embedded in each of said fins, each element having a cleaved, planar face, a portion of the planar face of each of said cutting elements which is not embedded in each fin being disposed to define a cutting surface to successively drill the formation upon rotation of the bit.

2. A rotary drill bit as defined in claim 1 wherein the diamond cutting elements are disposed such that an edge adjacent the planar face of the hemispherical cutting elements grooves into the formation.

3. A rotary drill bit as defined in claim 1 wherein the diamond cutting elements are positioned in said bit such that they have a leading edge in the direction of rotation of said bit and an outer edge distal from said matrix, and wherein the leading edge is inclined downward at a first angle α from a plane normal to the face of said bit and parallel to the direction of rotation and wherein the outer edge is inclined downward at a second angle β from a plane normal to the face of said bit and parallel to the intersection of the planar face of the diamond element with the face of said bit.

4. A rotary drill bit as defined in claim 3 wherein said first angle α is from about 30 to about 60 degrees.

5. A rotary drill bit as defined in claim 3 wherein said first angle α is about 45 degrees.

6. A rotary drill bit as defined in claim 4 wherein said second angle β is from about 15 to about 30 degrees.

7. A rotary drill bit as defined in claim 6 wherein said second angle β is about 30 degrees.

8. A rotary drill bit as defined in claim 3 wherein said first angle α is about 45 degrees and said second angle β is about 30 degrees.

9. A rotary drill bit as defined in claim 1 wherein the fins are configured so as to leave a core in the center of the bit.

10. A rotary drill bit as defined in claim 9 further comprising means for cutting away the core.

11. A rotary drill bit as defined in claim 10 wherein the means for cutting away the core comprises a disk shaped insert positioned within said bit, said insert including fluid passageways and a pair of hemispherically shaped diamond cutting elements.

12. A rotary drill bit as defined in claim 10 wherein the means for cutting away the core comprises a projection extending across the center of the bit, said projection including a pair of hemispherically shaped diamond cutting elements.

13. A rotary drill bit for drilling a hole in subterranean formations comprising:

a body portion including a matrix forming a face of said bit;

means to define fluid passageways across said matrix, said means dividing said matrix into a plurality of fins;

a plurality of hemispherically shaped diamond cutting elements each having a cleaved planar face, said elements being embedded in each of said fins such that a portion of the planar face of each element is exposed, the elements being positioned such that they have a leading edge in the direction of rotation of the bit and an outer edge distal from said matrix, wherein the leading edge is inclined downward at a first angle $\alpha$ from a plane normal to the face of the bit and parallel to the direction of rotation and wherein the outer edge is inclined downward at a second angle $\beta$ from a plane normal to the face of the bit and parallel to the intersection of the planar face of the diamond element with the face of the bit.

14. A rotary drill bit as defined in claim 13 wherein said first angle $\alpha$ is from about 30 to about 60 degrees.

15. A rotary drill bit as defined in claim 14 wherein said second angle $\beta$ is from about 15 to about 30 degrees.

16. A rotary drill bit as defined in claim 13 wherein said first angle $\alpha$ is about 45 degrees and said second angle $\beta$ is about 30 degrees.

* * * * *